US006942328B2

(12) United States Patent
Haldorsen

(10) Patent No.: US 6,942,328 B2
(45) **Date of Patent: *Sep. 13, 2005**

(54) KEYING METHODS AND APPARATUS FOR INKJET PRINT CARTRIDGES AND INKJET PRINTERS

(75) Inventor: Tom Haldorsen, Beaverton, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/857,128

(22) Filed: May 28, 2004

(65) Prior Publication Data

US 2004/0218025 A1 Nov. 4, 2004

Related U.S. Application Data

(63) Continuation of application No. 10/268,861, filed on Oct. 10, 2002, now Pat. No. 6,749,294.

(51) Int. Cl.[7] ..... B41J 2/175
(52) U.S. Cl. ..... 347/87

(58) Field of Search ..... 347/49, 86, 87, 347/214; 222/165, 325

(56) References Cited

U.S. PATENT DOCUMENTS

| | | | | | |
|---|---|---|---|---|---|
| 5,519,422 | A | | 5/1996 | Thoman et al. | |
| 5,530,531 | A | | 6/1996 | Girard | |
| 5,805,187 | A | * | 9/1998 | Sasaki | 347/86 |
| 5,880,764 | A | * | 3/1999 | Barinaga | 347/86 |
| 5,956,057 | A | | 9/1999 | Childers et al. | |
| 6,017,118 | A | | 1/2000 | Gasvoda et al. | |
| 6,290,346 | B1 | | 9/2001 | Santhanam et al. | |
| 6,431,697 | B1 | * | 8/2002 | King et al. | 347/86 |
| 6,749,294 | B2 | * | 6/2004 | Haldorsen | 347/87 |

* cited by examiner

*Primary Examiner*—Ahn T. N. Vo

(57) ABSTRACT

An inkjet printer and inkjet print cartridge are each especially configured for inter-engaging with one another via a plurality of keying features of the cartridge and keying structures of the printer such that loading of a foreign print cartridge into the printer is either not possible or results in the printer being inoperative. Thus, only print cartridges particularly configured and intended to be used in the printer will fit into the printer and enable its operation.

17 Claims, 11 Drawing Sheets

KEYING METHODS AND APPARATUS FOR INKJET PRINT CARTRIDGES AND INKJET PRINTERS

CROSS REFERENCE TO RELATED APPLICATIONS

This is a Continuation of U.S. patent application Ser. No. 10/268,861, filed on Oct. 10, 2002 now U.S. Pat. No. 6,749,294, which is assigned to the assignee of the present invention and incorporated herein by reference.

FIELD OF INVENTION

The present invention relates generally to inkjet print cartridges, to inkjet printers utilizing such inkjet print cartridges, and more particularly, relates to features for keying between the cartridge and printer.

BACKGROUND

The general construction and operation of an ink-jet print cartridge is disclosed in U.S. Pat. No. 4,771,295, entitled "Thermal Ink Jet Pen Body Construction Having Improved Ink Storage and Feed Capacity," by Baker, et al., issued 13 Sep. 1988.

The general design and construction of an ink-jet printer with a carriage that retains and aligns ink-jet print cartridges in a printer and scans these print cartridges through print zones is well known. Examples of the patents that have issued in this field of technology include: U.S. Pat. No. 4,755,836, entitled "Printhead Cartridge and Carriage Assembly," by Ta, et al., issued 5 Jul. 1988; U.S. Pat. No. 4,872,026, entitled "Inkjet Printer with Printhead Carriage Alignment Mechanism," by Rasmussen, et al., issued 3 Oct. 1989; U.S. Pat. No. 4,907,018, entitled "Printhead-Carriage Alignment and Electrical Interconnect Lock-in Mechanism," by Pinkerpell, issued 6 Mar. 1990; U.S. Pat. No. 5,392,063, entitled "Spring Cartridge Clamp for Inkjet Printer Carriage," by Rhoads, issued 21 Feb. 1995, and U.S. Pat. No. 4,706,097, by Harmon, entitled, "Near-linear Spring Connect Structure for Flexible Interconnect Circuits," dated 10 Nov. 1987.

Ink-jet print cartridges generally include keying features which mate with corresponding features on the print carriage. Because of the keying features, only properly keyed cartridges may be utilized in a particular printer, or a printer may identify a particular ink jet cartridge by its keying features. Inkjet printers are configured and programmed to use particular print cartridges in order to print properly. Black printing of text, printing of low resolution color images and text, and printing of high resolution photographs and images may all use different print cartridges. Accordingly, the different print cartridges for use in a particular printer may utilize and present different keying features for engagement with the printer, allowing identification of the print cartridge.

Further, print cartridges that are not properly configured for a particular printer may cause unsatisfactory printing if used in a printer not intended or designed to use those particular cartridges. Thus, it is important both from a standpoint of proper printer operation for various printing jobs, and from the standpoint of customer satisfaction with the performance of an inkjet printer that only appropriate print cartridges be used.

Prior ink-jet printers, and prior ink-jet print cartridges have been designed generally so that the print cartridge is loaded and unloaded into and from the carriages of these printers either by relatively moving the cartridge vertically, or by moving the cartridge substantially vertically along with a steep, inclined, arcuate motion. The arcuate motion generally tips the print cartridge into latching engagement with a latching spring. An alternative arrangement utilized a latching lever that the user must pivot after insertion of the print cartridge in order to latch the print cartridge into operative position.

However, conventional inkjet printers and their cartridges either had no keying to provide only for properly configured cartridges to be used in a particular printer, or had a keying scheme that provided for only a single direction of engagement between keying features on the cartridge and a key engagement member or feature on the printer carriage. Thus, this dearth of keying alternatives limited the design flexibility that was available to designers of inkjet printers, and of cartridges for these printers.

SUMMARY OF THE INVENTION

Briefly and in general terms, an ink-jet print cartridge, and ink-jet printer method and apparatus according to embodiments of the invention includes a generally rectangular prismatic print cartridge body, with the body having at least a two dimensional array, and possibly a three dimensional array, of keying features arrayed on the body at a particular location. The keying features may be binary or have a greater than binary degree of freedom for identification. By "binary" is meant that at each designated location of the array where a keying feature may appear, a keying feature or "lug" may be present or absent. The presence of a keying lug may be considered to be a "1" value at that location, while the absence of a keying feature lug at the particular location may be considered a "0" binary value at that location. If the keying features have greater than a binary degree of freedom, then they may be absent, or present at a particular location of the array, and if present, may have one of several different heights. Each height of a particular keying feature is a distinct key value.

Further, the array of keying features may preferably be configured such that a key engagement member or feature carried by a carriage of an inkjet printer may approach and engage with the keying features from one or more of an "X", "Y", or "Z" direction. Depending on the positions of particular keying features in a particular array (i.e., meaning, for example, the locations of the "1" values in the selected locations of an array), then keying features of the carriage may approach and engage with the keying lugs of the cartridge in two or all three of the "X", "Y", and "Z" directions.

This enhanced flexibility in keying a printer carriage to print cartridges that are to be received into that printer and carriage provides a designer of inkjet printers with a wide variety of convenient arrangements for keying a cartridge and carriage so that only appropriate cartridges are utilized in a particular printer, and the performance of the printer, and customer satisfaction with the printer are better assured.

Other aspects and advantages of the invention will become apparent from the following detailed description of selected preferred exemplary embodiments of the invention, taken in conjunction with the accompanying drawings, which illustrate the principles of the invention by way of example. Throughout the accompanying drawing Figures, like reference numerals indicate either the same feature, or features which are analogous in structure or function.

BRIEF DESCRIPTION OF THE DRAWING FIGURES

FIG. 1 provides a diagrammatic perspective view of a generalized ink jet print cartridge embodying the present invention and including a keying arrangement;

FIG. 1*a* is a diagrammatic representation of a keying feature array as is seen in FIG. 1;

FIG. 2*a* provides a diagrammatic perspective view of an ink jet print cartridge embodying the present invention, and providing a one dimensional keying arrangement, and illustrating an example of one dimensional engagement of the keying features;

FIG. 2*b* provides a top plan view of the ink jet print cartridge seen in FIG. 2*a*, and provides an illustration of an alternative one dimensional engagement of the keying features along an orthogonal axis different than the one illustrated in FIG. 2*a;*

FIG. 3*a* provides a diagrammatic perspective view of an ink jet print cartridge embodying the present invention, and providing a two dimensional keying arrangement, and illustrating an example of one dimensional engagement of the keying features;

FIG. 3*b* provides a top plan view of the ink jet print cartridge seen in FIG. 3*a*, and also provides an alternative example of a one dimensional engagement of the keying features along an orthogonal axis different than the one illustrated in FIG. 3*a;*

FIG. 4*a* provides a diagrammatic perspective view of an ink jet print cartridge embodying the present invention, and providing a two dimensional keying arrangement, and illustrating an example of one dimensional engagement of the keying features;

FIG. 4*b* provides a top plan view of the ink jet print cartridge seen in FIG. 4*a*, and also provides two alternative examples of one dimensional engagement of the keying features (for a total of three dimensions of keying feature engagement) along respective orthogonal axes different from one another and also different and orthogonal to the one illustrated in FIG. 4*a;*

FIG. 5*a* provides a diagrammatic perspective view of an ink jet print cartridge embodying the present invention, and providing a three dimensional keying arrangement, and illustrating an example of one dimensional engagement of the keying features;

FIG. 5*b* provides a top plan view of the ink jet print cartridge seen in FIG. 5*a*, and also provides two alternative examples of one dimensional engagement of the keying features (for a total of three dimensions of keying feature engagement) along respective orthogonal axes different from one another and also different and orthogonal to the one illustrated in FIG. 5*a;*

FIG. 6 provides a perspective view of an ink-jet printer embodying the present invention;

FIG. 7 provides a diagrammatic cross sectional view of the printer seen in FIG. 1;

Figure 13:
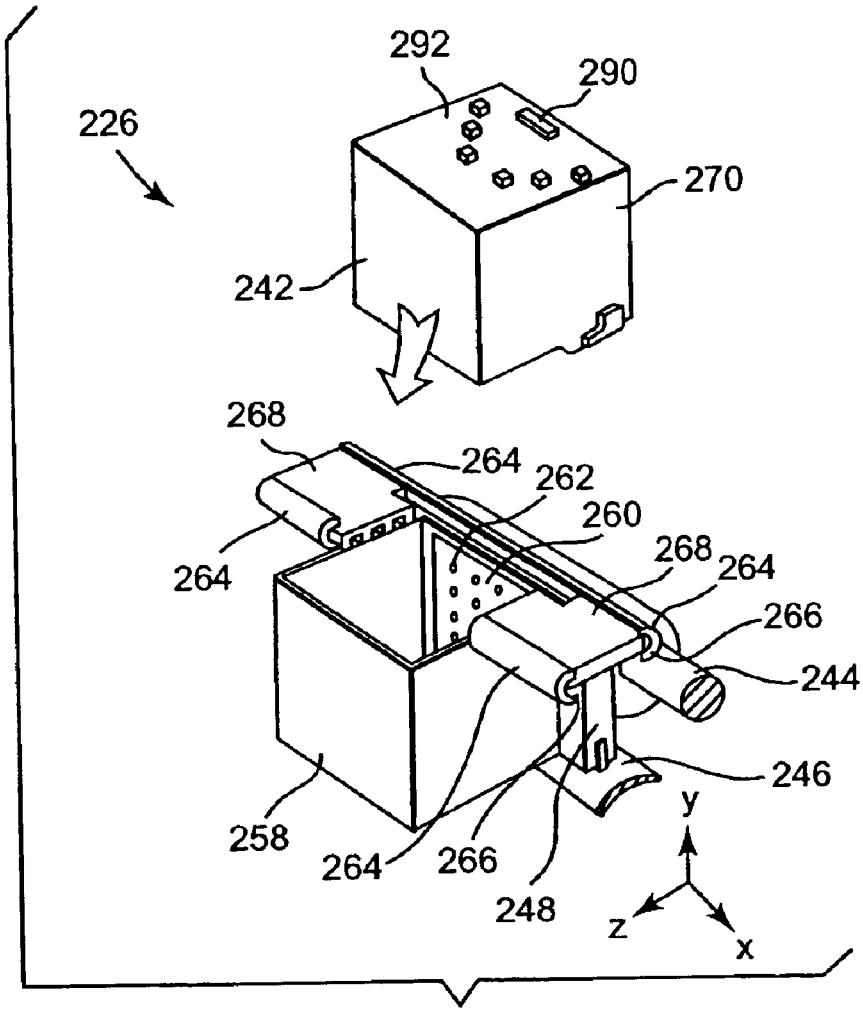
FIG. 13 is a fragmentary perspective view of a carriage portion of an alternative embodiment of printer, and is shown in a condition preparatory to receiving a print cartridge also seen in this drawing Figure.
Figure 14:
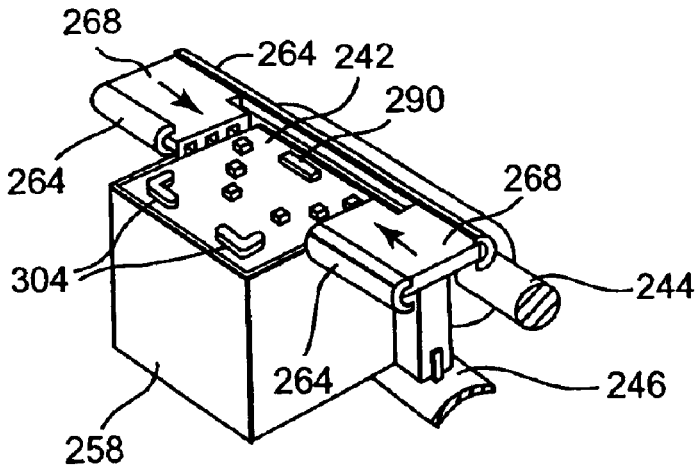
FIG. 14 is a fragmentary perspective view of the carriage portion of the printer seen in FIG. 13, and is shown with the print cartridge received into the carriage.
Figure 15:
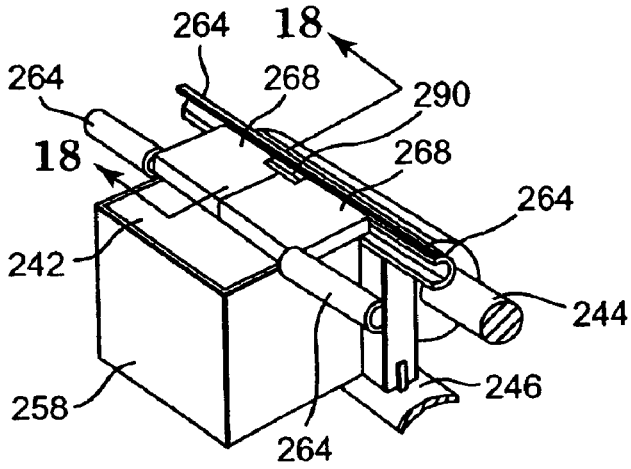
FIG. 15 is a fragmentary perspective view of the carriage portion of the printer seen in FIGS. 13 and 14, and is shown with the print cartridge latched into an operative position in the carriage by lateral movements of pair of keying members of the carriage.
Figure 16:
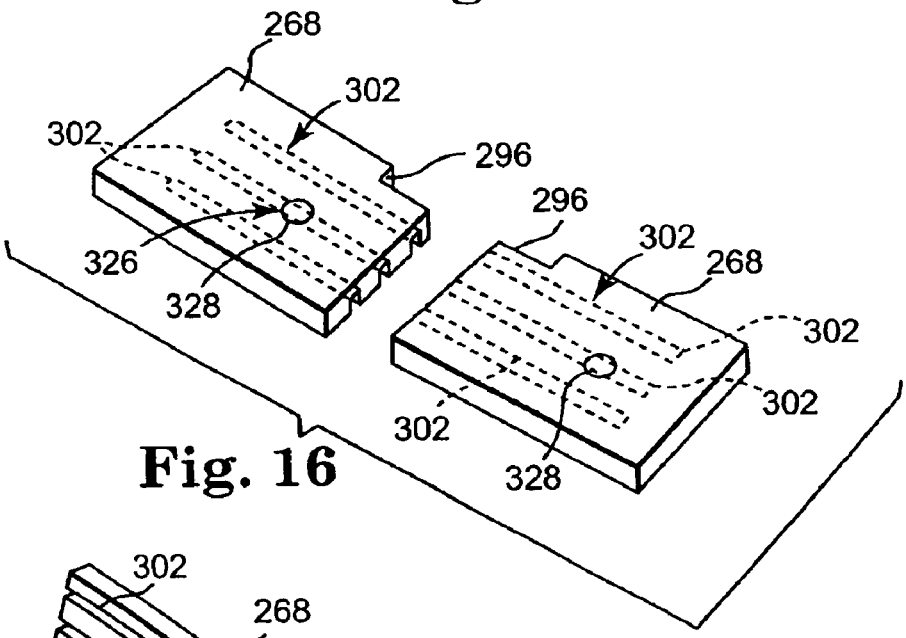
Figure 17:
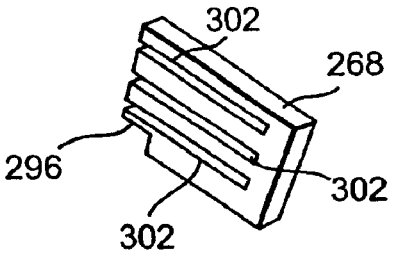
Figure 18:
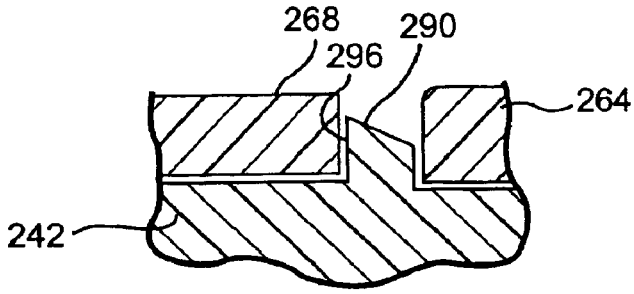
Figure 19:
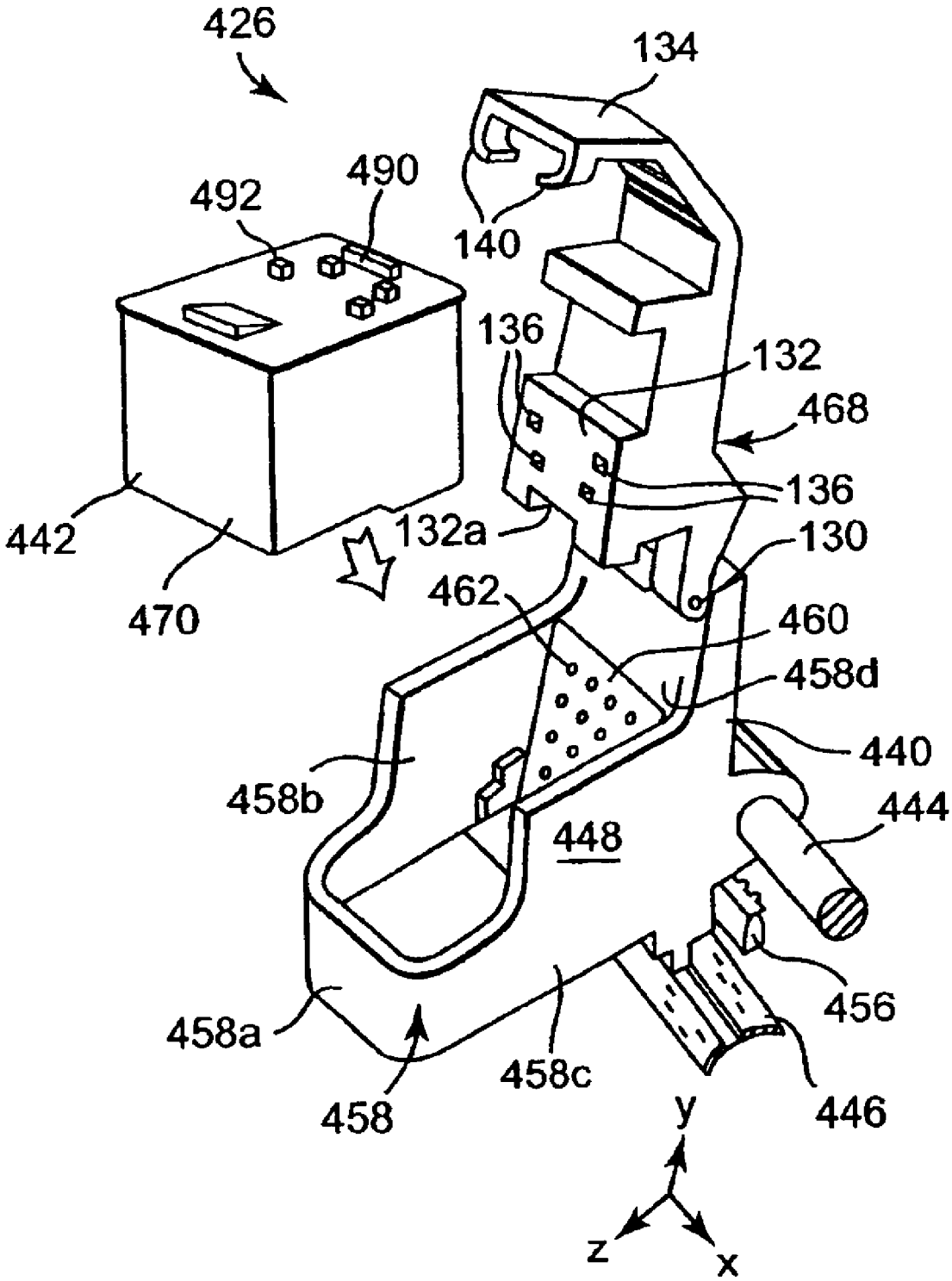
Figure 20:
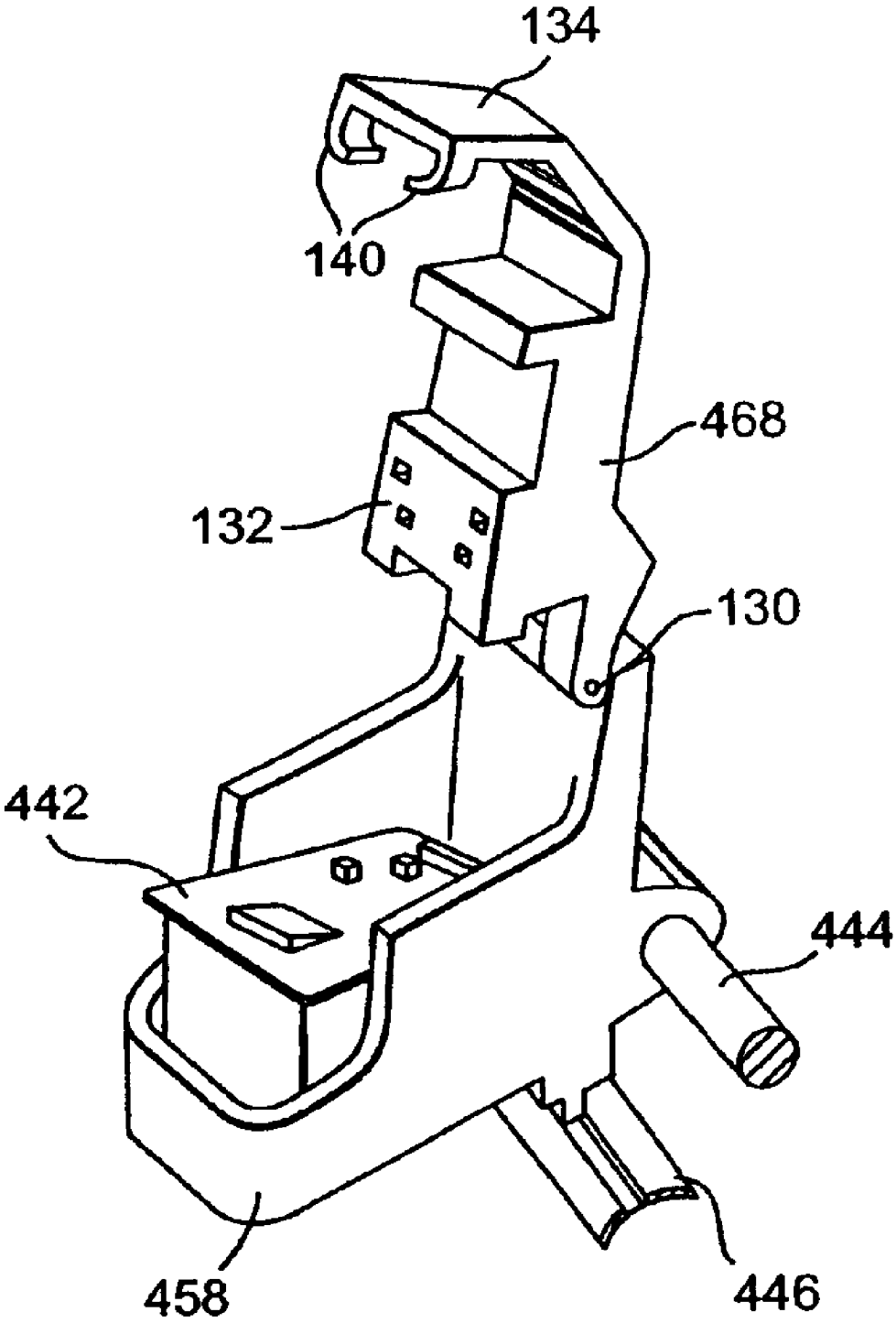
Figure 21:
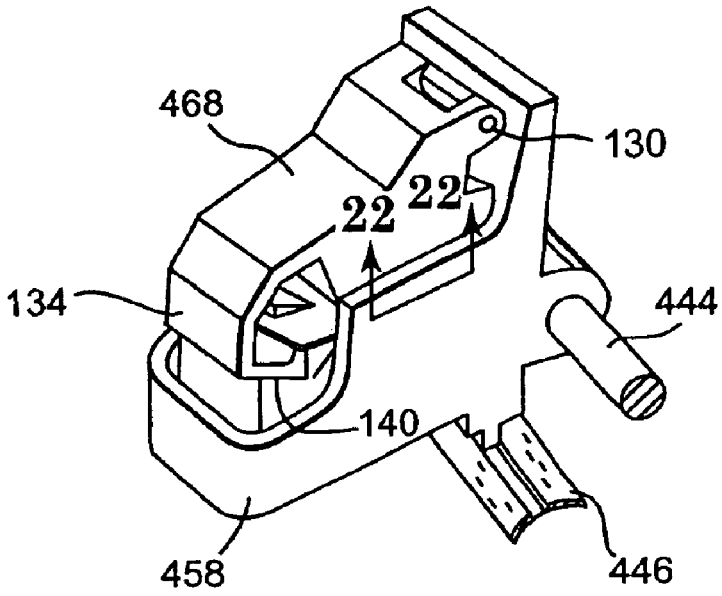
Figure 22:
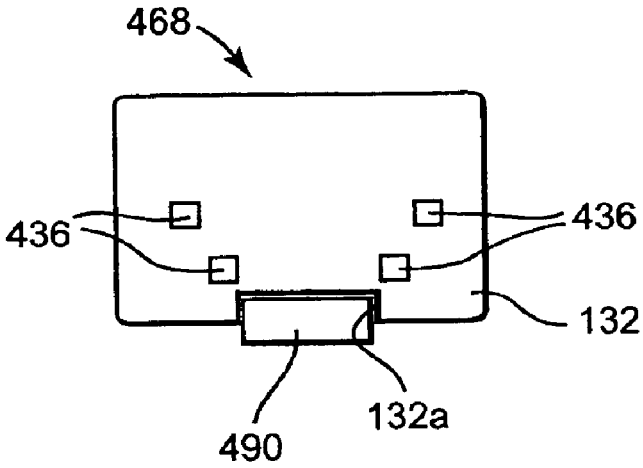
Figure 23:
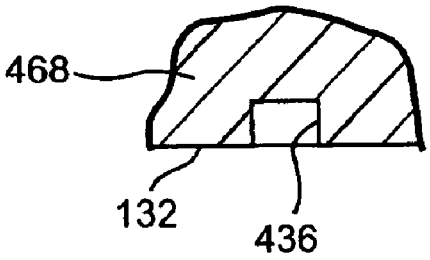

FIGS. 16, 17, and 18 are respective isolation top, underside, and fragmentary cross sectional views of the keying members of the carriage seen in FIGS. 13–15, with the fragmentary cross sectional view of FIG. 18 being taken at line 18—18 of FIG. 15;

FIG. 19 is a fragmentary perspective view of a carriage portion of another alternative embodiment of printer, and is shown in a condition preparatory to receiving a print cartridge also seen in this drawing Figure;

FIG. 20 is a fragmentary perspective view of the carriage portion of the printer seen in FIG. 19, and is shown with the print cartridge received into the carriage;

FIG. 21 is a fragmentary perspective view of the carriage portion of the printer seen in FIGS. 19 and 20, and is shown with the print cartridge latched into an operative position in the carriage by downward pivotal movement of a keying and latching member of the carriage;

FIG. 22 is a fragmentary isolation underside view of the keying and latching member of the carriage seen in FIGS. 19–21, with the view of FIG. 22 being taken at line 22—22 of FIG. 21; and FIG. 23 is a fragmentary cross sectional view taken at line 23—23 of FIG. 22, with the cross section oriented according to FIG. 21.

DESCRIPTION OF EXEMPLARY PREFERRED EMBODIMENTS OF THE INVENTION

Figure 1:
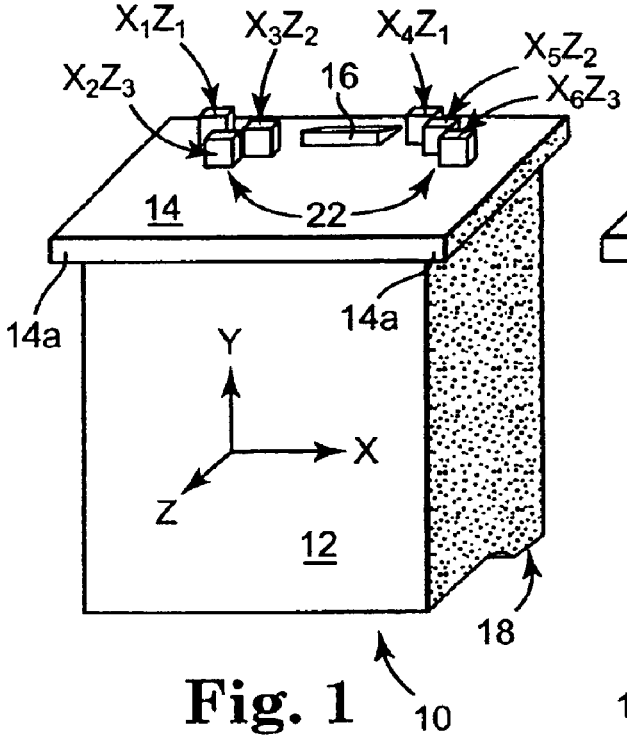

Considering first FIG. 1, a generalized diagrammatic ink jet print cartridge 10 is shown in perspective view. This print cartridge includes a body 12 with a lid 14. Disposed on the lid 14 is a latching ramp 16. The body 12 includes a downwardly depending portion 18 outwardly on which is secured a print head (not visible in the drawing Figures). The lid portion 14 includes a pair of opposite outwardly extending flange parts 14*a*. Superimposed on the drawing FIG. 1 is a coordinate axis symbol 20, establishing directions which are referred to herein below.

Figure 1A:
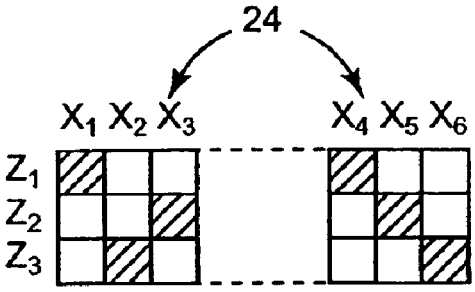

Disposed upon the lid 14 adjacent to and arrayed around the latching ramp 16, is a plurality of keying features 22. The keying features 22 occupy positions of an array 24, as is better seen in plan view in FIG. 1*a*. As can be seen viewing FIG. 1*a*, in this generalized case, the keying features 22 occupy positions: X1Z1, X2Z3, X3Z2, X4Z1, X5Z2, and X6Z3. That is, a keying feature at each of these locations has a Y value of "1" or greater. At the other locations of the array 24 no keying feature is present, so these locations have a value of "zero." However, as is seen at the location X1Z1, the keying features may have a value of more than "one." That is, the keying features 22 may have a height above the lid 14 that is more than a unity value of Y dimension. The keying feature at location X1Z1 has a Y height value of approximately 1.5. Thus, the ink jet print cartridge 10 is uniquely identifiable by reference to the locations and height values of the keying features 22 in array 24.

Further, viewing FIG. 1, it will be appreciated that the keying features 22 are engageable by movement of an engagement or identification member (not seen in FIG. 1) along any one of at least three orthogonal axes. These axes are identified as directions X, Y, and Z in FIG. 1, although the invention is not so limited. By way of example, and as will be further explained and illustrated below by reference to alternative embodiments of the invention, the keying features 22 may be engaged from "above" (i.e., in the negative Y direction) by an engagement or sensing member moving downwardly from above the print cartridge 10. Alternatively, an engagement or keying member (or members) may approach and engage with or sense the presence of the keying features 22 from any one or more or a combination of the positive or negative X or Z directions.

Figure 2A:
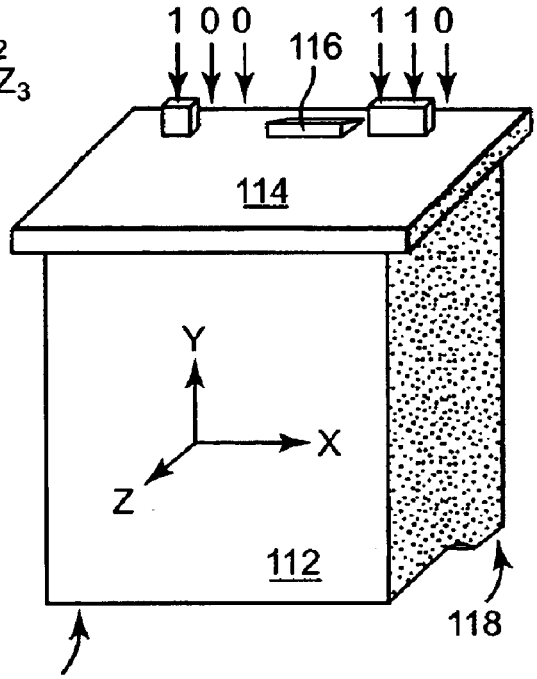
Figure 2B:
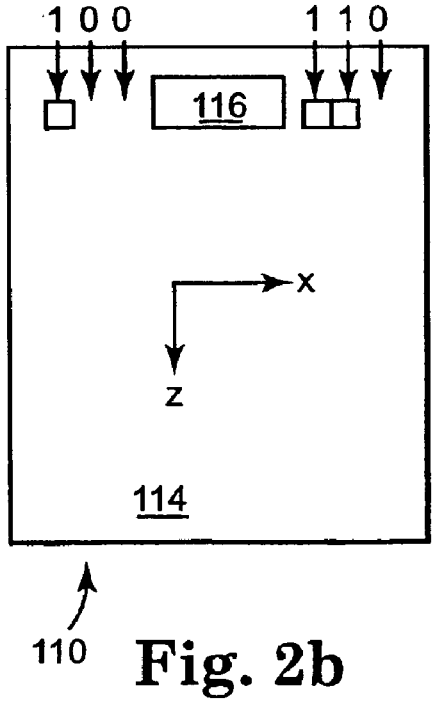

In order to consider an alternative example of an ink jet print cartridge embodying the invention, attention is now directed to FIGS. 2*a* and 2*b*. Because the embodiment of FIGS. 2*a* and 2*b* has many features in common with the first embodiment of FIG. 1, these features are referenced with the same numeral used above, and increased by one-hundred (100). Viewing FIGS. 2*a* and 2*b*, it is seen that the ink jet print cartridge 110 includes a single-row array of keying features 122. That is, the keying features 122 are all in a single row along the X direction, and further, all of the features 122 have a unity height. Thus, all of the keying features of the array 124 (six array locations being indicated on FIGS. 2*a* and 2*b*, although the invention is not so limited) are binary in nature, and are either a "zero" value, or a "one" value. In this case, the binary "one" values are located at X1, X4, and X5, with the other locations (i.e., X2, X3, and X6) each having a "zero" value.

Viewing FIG. 2*a*, it is seen that the keying features 122 can by "read" by a keying engagement member or sensing member (not seen in the drawing Figures) which moves from above the print cartridge 110 downwardly onto the keying features 122 (i.e., in the negative Y direction). Alternatively, the keying features 122 may be read or sensed by an engagement or sensing member moving in the Z direction, as is depicted by the arrows on FIG. 2*b*. Thus, this embodiment provides a one dimensional array of keying features (i.e., extending only in the X direction), which may be read or engaged or sensed in either the negative Y direction, or in the Z direction (positive or negative). This embodiment provides a one dimensional keying array with the possibility of two dimension sensing or engagement with the keying array.

Figure 3A:
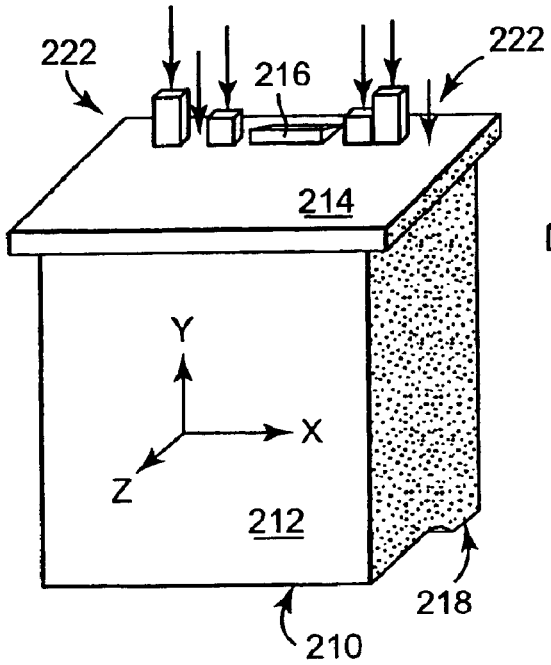
Figure 3B:
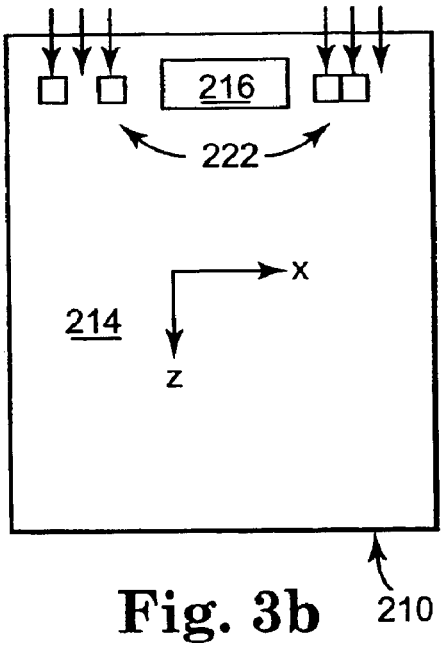

A third alternative example of an ink jet print cartridge embodying the invention is illustrated in FIGS. 3*a* and 3*b*. Again, because the embodiment of FIGS. 3*a* and 3*b* has many features in common with the earlier embodiments of the inventive print cartridge, these features are referenced with the same numeral used above, and increased by two-hundred (200). Viewing FIGS. 3*a* and 3*b*, it is seen that the ink jet print cartridge 210 includes a single-row array of keying features 222. That is, the keying features 222 are all in a single row along the X direction. But, in this embodiment the features 222 may have a "zero" height, or may have a unity height (binary "1" value), or may have a height that is more than unity value (thus adding another dimension to the array 222 in which information is physically stored). Thus, all of the keying features of the array 224 (six array locations being indicated on FIGS. 3*a* and 3*b*, although the invention is not so limited) are tertiary in nature, and may have a "zero" value, or a "one" value, or a value that is more than "one." In this case, the binary "zero" values are located at X2 and X6, while the locations X3 and X4 have unity or binary "one" values. Finally, it is to be noted that locations X1 and X5 have values above "one," which tertiary values may be 1.5 or 2.0, for example.

Viewing FIG. 3*a*, it is seen that the keying features 222 can by "read" by a keying engagement member or sensing member (not seen in the drawing Figures) which moves from above the print cartridge 210 downwardly onto the keying features 222 (i.e., in the negative Y direction). Alternatively, the keying features 222 may be read or sensed by an engagement or sensing member moving in the Z direction, as is depicted by the arrows on FIG. 3*b*. It is to be noted that in the event that reading or sensing of the keying features 222 is effected along the Z axis, as depicted in FIG. 3*b*, then the height value of the keying features (i.e., in the Y direction) is to be sensed also in order to obtain all the identification information that is present in the keying features 222. Thus, this embodiment provides a two dimensional array of keying features (i.e., extending in the X direction and in the Y direction), which may be read or engaged or sensed in either the negative Y direction, or in the Z direction (positive or negative). This embodiment provides a two dimensional keying array with the possibility of two dimension sensing or engagement with the keying array.

Figure 4A:
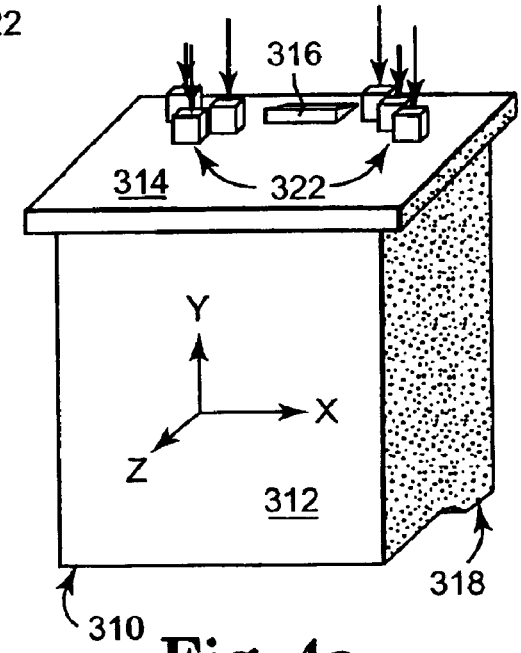
Figure 4B:
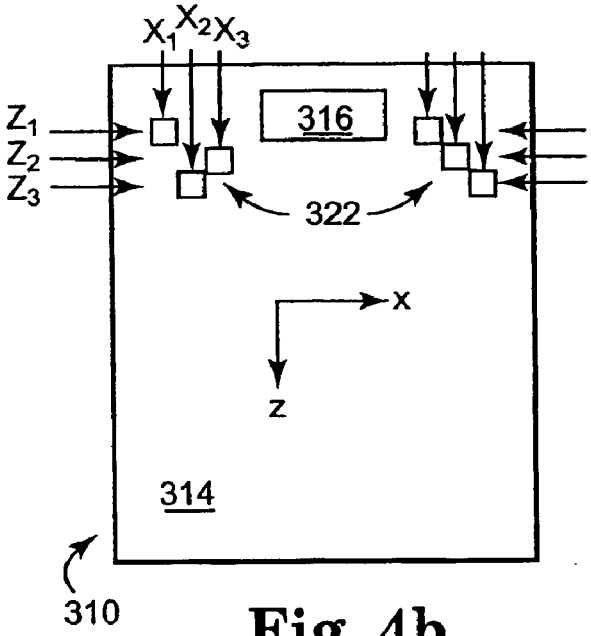

A fourth alternative example of an ink jet print cartridge embodying the invention is illustrated in FIGS. 4*a* and 4*b*. Again, because the embodiment of FIGS. 4*a* and 4*b* has many features in common with the earlier embodiments of the inventive print cartridge, these features are referenced with the same numeral used above, and increased by three-hundred (300). Viewing FIGS. 4*a* and 4*b*, it is seen that the ink jet print cartridge 310 includes three rows of keying features 322 in an array 324. That is, the keying features 322 are at locations in an array sized and configured as seen earlier in FIG. 1*a*. Again, in this embodiment the features 322 may have a "zero" height, or may have a unity height (binary "1" value). Thus, all of the keying features of the array 324 (18 array locations being indicated on FIGS. 4*a* and 4*b*, although the invention is not so limited) are binary in nature, and may have a "zero" value, or a "one" value. In this case, the binary "zero" values are located at X1Z2, X1Z3, X2Z1, X1Z2, X3Z1, X3Z3, X4Z2, X4Z3, X5Z1, X5Z3, X6Z2 and X6Z2, while the remaining locations of the array (6 locations in this example) have unity or binary "one" values.

Viewing FIG. 4*a*, it is seen that the keying features 322 can by "read" by a keying engagement member or sensing member (not seen in the drawing Figures) which moves from above the print cartridge 310 downwardly onto the keying features 322 (i.e., in the negative Y direction). Alternatively, the keying features 322 may be read or sensed by an engagement or sensing member moving in the Z direction, as is depicted by the arrows on FIG. 4*b*. Still alternatively, the keying features 322 may be read or sensed by engagement or sensing members moving in the X direction, as is depicted by the arrows on FIG. 4*b*. It is to be noted that the sensing along the X axis of keying features 322 may require two members moving along the X axis. Of course, sensing of the keying features may also be carried out electrically or optically, which does not require "movement" at all along any of the reference axes.

Figure 5A:
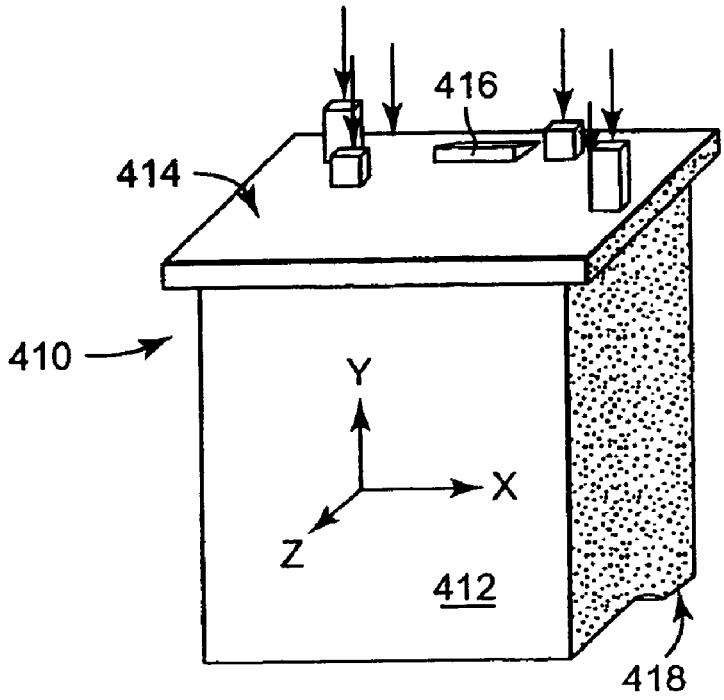
Figure 5B:
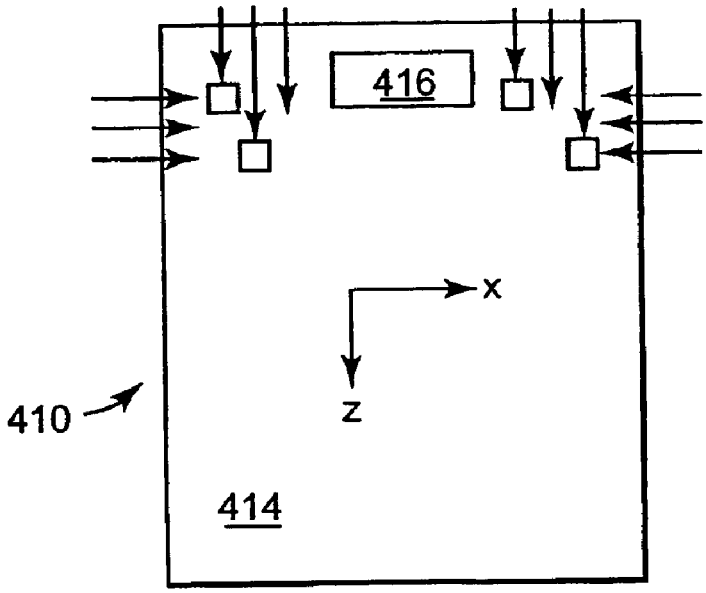

Finally, a fifth alternative example of an ink jet print cartridge embodying the invention is illustrated in FIGS. 5*a* and 5*b*. Again, because the embodiment of FIGS. 5*a* and 5*b* has many features in common with the earlier embodiments of the inventive print cartridge, these features are referenced with the same numeral used above, and increased by four-hundred (400). Viewing FIGS. 5*a* and 5*b*, it is seen that the ink jet print cartridge 410 includes three rows of keying features 422 in an array 424. That is, the keying features 422 are at locations in an array sized and configured as seen earlier in FIG. 1*a*. However, in this embodiment the features 422 may have a "zero" height, or may have a unity height (binary "1" value), or may have a height that is greater than unity. Thus, all of the keying features of the array 424 (18 array locations being indicated on FIGS. 5*a* and 5*b*, although the invention is not so limited) are tertiary in nature, and may have a "zero" value, or a "one" value, or may have a height value that is greater than "one." In this case, the binary "zero" values are located at X1Z2, X1Z3, X2Z1 X2Z2, X3Z1, X3Z2, X2Z3, X4Z2, X4Z3, X5Z1, X5Z2, X5Z3, X6Z1 and X6Z2, while the remaining locations of the array (4 locations in this example) have a height value of unity or greater. That is, the locations X2Z3, and X4Z1 have a "one" height value. On the other hand, the locations X1Z1, and X6Z3 have height values that are more than one (i.e., 1.5 or 2.0, for example).

As before, viewing FIG. 5*a*, it is seen that the keying features 422 can by "read" by a keying engagement member or sensing member (not seen in the drawing Figures) which moves from above the print cartridge 410 downwardly onto the keying features 422 (i.e., in the negative Y direction). Alternatively, the keying features 422 may be read or sensed by an engagement or sensing member moving in the Z direction, or in the X direction (two engagement or sensing members possibly required) as is depicted by the arrows on FIG. 4*b*.

Figure 6:
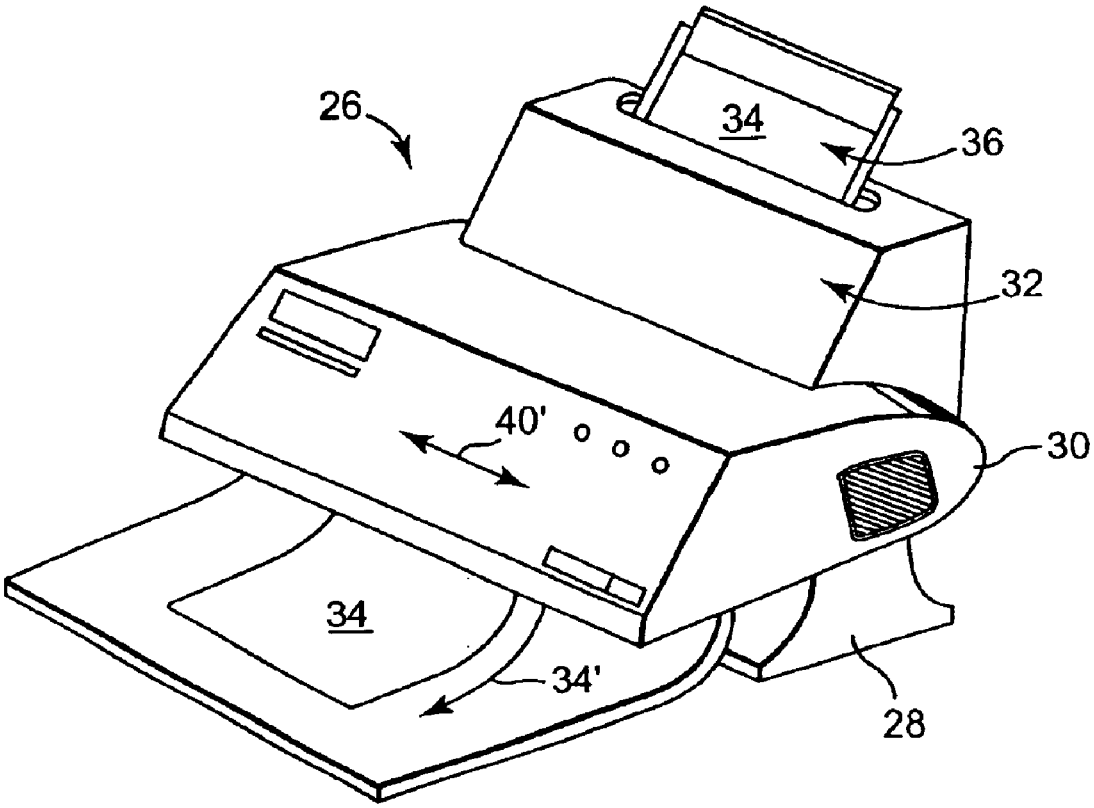
Figure 7:
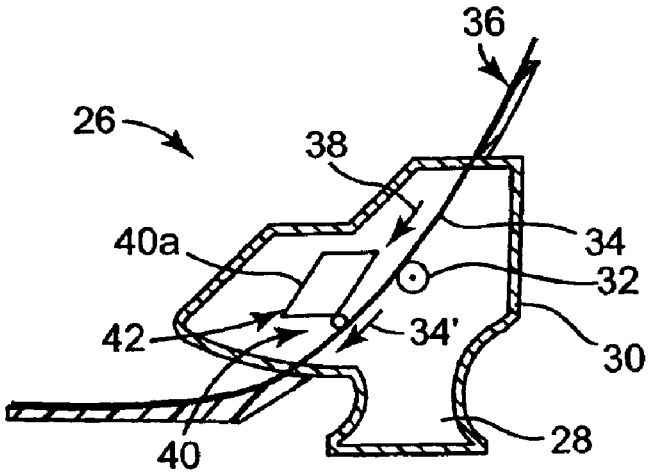

Having considered the structure and possible identification functions of ink jet print cartridges embodying the present invention, attention may now be directed to implementations of this invention in ink jet printers. Considering FIGS. 6 and 7, an exemplary inkjet printer 26 is depicted. This printer 26 includes a base 28 carrying a housing 30. Within the housing 30 is a feed mechanism 32 for controllably moving a print medium 34 (i.e., sheet paper, light card stock, multi-layer photo printing paper, or plastic printing film, for example, and without limitation) through the printer 26. The feed mechanism 32 controllably moves a sheet of the print media 34 from a magazine 36 along a print path 38 within the printer 26. The printer 26 includes a traverse mechanism 40 (indicated on FIG. 1 with double arrow 40') with a carriage 40*a* carrying one or more inkjet print cartridges, which cartridges are generally referenced in FIG. 2 with the numeral 42.

The traverse mechanism 40 controllably moves the inkjet print cartridge(s) 42 perpendicularly to the direction of movement of the paper 34 (i.e., the media 34 is moved in the direction of arrow 34' in FIGS. 1 and 2, and perpendicular to the plane of FIG. 2; while the cartridge(s) 26 are moved perpendicularly to the plane of FIG. 2, and in the directions of double headed arrow 40' of FIG. 1). Noting the coordinate direction system set out on FIG. 2, it is seen that the direction of arrow 34' is in the positive "Z", direction, and the direction of traverse of carriage 40*a* is bi-directional along the "X" direction.

As those ordinarily skilled in the art of inkjet printing will understand, the printer 26 uses the inkjet printing cartridge (s) 42 to controllably place small droplets of printing fluid (i.e., ink, for example) from the inkjet printing cartridge(s) 42 on the paper 34. The small ink droplets form "pixels" of printed characters or images. By moving the inkjet printing cartridge(s) 42 repeatedly back and forth (i.e., scanning the cartridges) across the paper 34 in the direction of arrow 40' as this paper 34 is controllably advanced by the feed mechanism 32 in direction 34', characters or images may be controllably formed by ejection of the small droplets of ink from the cartridge(s) 42. These small droplets of ink are ejected in the form of fine-dimension ink jets impinging on the paper 34 in controlled locations to form characters and images, as will be well known to those ordinarily skilled in the pertinent arts.

Figure 8:
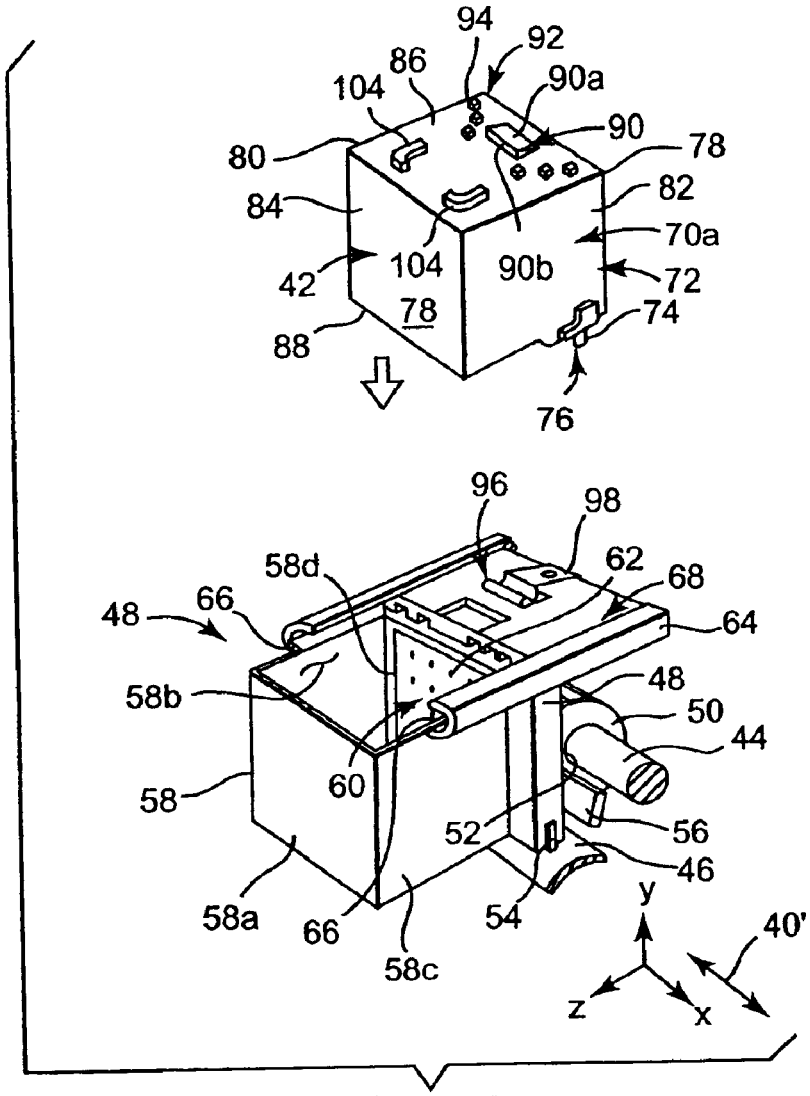
FIG. 8 is a fragmentary perspective view of a carriage portion of the printer seen in FIGS. 7 and 8, and is shown in a condition preparatory to receiving a print cartridge also seen in this drawing Figure.

FIG. 8 illustrates a portion of the mechanism of a typical ink jet printer, like printer 26, and of an ink jet print cartridge. As is seen in FIG. 8, the printer includes a horizontally extending elongate guide rod 44, only a portion of which is seen in FIG. 8. This guide rod 44 is spaced above and is parallel to a horizontally extending elongate guide rail 46. Only a portion of the guide rail 46 is depicted in FIG. 8. Carried upon the guide rod 44 and upon the guide rail 46 is a carriage base part 48, which is the part of the traverse mechanism 40 and of carriage 48 (which actually receives and carries the print cartridge 42). As is seen in FIG. 8, the carriage base part 48 includes a boss 50 defining a through bore 52. The guide rod 44 is slidably received through bore 52 so that the carriage 48 is slidable horizontally along this guide rod 44. The carriage base part 48 includes a shoe 54 which slidably rests upon the guide rail 46. Thus, the carriage base part 48 is reciprocal on the guide rod 44 and guide rail 46. A toothed belt 56, only a fragment of which is illustrated in FIG. 8, is drivingly connected to the carriage base part 48, and is reciprocated controllably by a motor drive mechanism (not seen in the drawing Figures) so that the carriage 48 is movable and may be selectively positioned laterally along the guide rod 44, as is indicated by arrows 40' in FIG. 8.

Upon the carriage base part 48 is carried an upwardly and downwardly opening chute 58 having a front wall 58*a*, a pair of side walls 58*b*, 58*c*, and a rear wall 58*d*. At the rear wall 58*d*, a flexible circuit 60 is exposed within the chute 58. The flexible circuit 60 carries and exposes an array of electrical contact pads 62 within the chute 58. In order to provide for receiving and retaining a print cartridge 42 in the chute 58, a pair of guide ways 64 are arranged one on each side of the chute 58, with the guide ways 64 extending from front to back of the chute 58. These guide ways 64 have a respective elongate C-shaped recess or groove 66 in each one, with the recesses facing toward one another. Slidably carried in the recesses 66 of the pair of guide ways 64 is a keying and latching member 68, which will be further explained below.

Further considering FIG. 8, it is seen that the print cartridge 42 includes a cartridge body 70, which internally defines an ink reservoir (generally referenced with the arrowed numeral 70*a*), and a fluid delivery assembly (generally referenced with the arrowed numeral 72) supplying printing fluid (such as ink of particular types, recalling the explanation above) to one or more respective print head(s) 74. The print head(s) 74 is carried by the printing cartridge body 70. If the cartridge 42 is for printing only black ink, then the print head 74 will usually be singular. On the other hand, if the cartridge 42 is for color printing (i.e., for cyan, magenta, and yellow inks, for example, and without limitation) then the print heads 74 will generally be three in number.

The fluid delivery assembly 72 may include a sponge carried within a chamber of the body 70 and a standpipe (the sponge, chamber, and standpipe not being individually illustrated in the drawing Figures), conveying the printing fluid from one or more of the chamber(s) 70*a* to the print head(s) 74. As those ordinarily skilled in the relevant printing arts will understand and know, the print head(s) 74 each include a printing circuit which electrically couples the print head 74 via circuit traces and electrical contacts (i.e., those of the flexible circuit 60) with driving electronics (not illustrated in the drawing Figures) of the printer 26. That is, the print heads 74 have plural fine-dimension orifices (indicated by the arrowed numeral 76) directed toward the print media 34. From individually addressable ones of these print orifices 76 respective fine-dimension jets of printing fluid are directed onto the print media in order to form characters and images.

Further considering FIG. 8, it is seen that the print cartridge body 70 is generally of rectangular prismatic shape. This body has a front wall 78 (not seen in FIG. 3), a left side wall 80 (not seen in FIG. 8), a right side wall 82, a rear wall 84, a top wall 86, and a bottom wall 88 (not seen in FIG. 3). The print head(s) 74 are mounted to the bottom wall 88, and a circuit (not seen in the drawing Figures) is attached to the front wall 82, and connects an array of electrical contacts matching those seen on the flexible circuit 60 to the print head 74.

Included on the top wall 86 is a latch feature 90 that is spaced somewhat rearwardly away from a front margin where the front wall and top wall intersect. The latch 90 along with additional features of the cartridge 42 to be further described hereinbelow, serve to secure and allow the securing of the print cartridge 42 within a printer carriage. As is illustrated in FIG. 8, the latch 90 has a triangular cross section formed by a latch ramp 90*a* and a vertically extending latch wall 90*b*. Also arrayed on the top wall 86 is an array of three rows and 6 columns of binary keying features 92. In the illustrated example, the keying features correspond with those illustrated and described above by reference to FIGS. 4*a* and 4*b*, in that the keying features are binary and have either a "zero" or a "one" height value. Thus, a total of 18 possible key locations are presented, although the invention is not so limited. It will be noted that in the illustrated example, the key values of "1" are located at X1Z1, X2Z2, X3Z3, X4Z3, X5Z2, and X6Z1. All of the other locations of the eighteen possible key locations have no key block or pin, so they have a "0" value.

Figure 9:
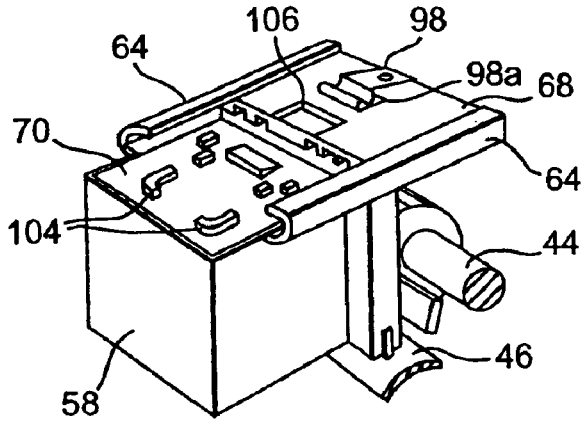
FIG. 9 is a fragmentary perspective view of the carriage portion of the printer seen in FIG. 8, and is shown with the print cartridge received into the carriage.
Figure 10:
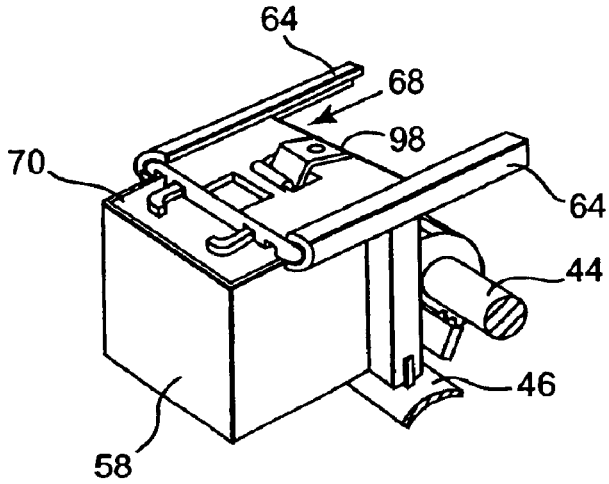
FIG. 10 is a fragmentary perspective view of the carriage portion of the printer seen in FIGS. 8 and 9, and is shown with the print cartridge latched into an operative position in the carriage by movement of a keying member of the carriage.
Figure 11:
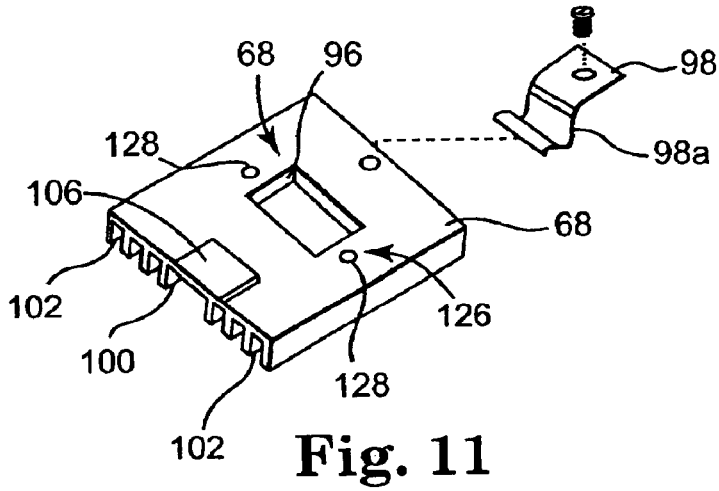
FIG. 11 is an isolation top view of the keying member of the carriage seen in FIGS. 8–10.
Figure 12:
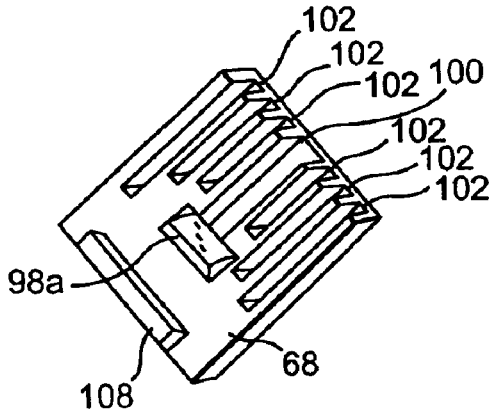
FIG. 12 is an isolation underside view of the keying member of the carriage seen in FIGS. 8–10.

Considering now in FIGS. 11 and 12 the latch and key member 68 in greater detail, it is seen that this member 68 is generally plate-like, and is slidably carried in the guide ways 64 for sliding movements in the "Z" direction between a first position in which the entire latch and key member 68 is behind the upwardly directed opening of chute 58, and a second position in which the member 68 extends partially forward across the open top of the chute 58 (i.e., as is seen in FIGS. 9 and 10). FIG. 11 best reveals that the member 68 defines an opening or window 96. At this opening 96, a latch spring member 98 is mounted so that a depending catch feature 98*a* of this spring extends downwardly through the window to project somewhat below the member 68. As is seen in FIG. 12, on the underside of the member 68 a groove 100 extends to the window 96 in alignment with the catch feature 98*a*. The groove 100 is sized to accept the latch feature 90 of the print cartridge 42.

Also considering FIGS. 11 and 12, it is seen that the member 68 also defines six grooves 102, each aligning respectively with one of the columns of the keying features 92. That is, the grooves 102 are elongate in the Z direction, according to the placement of the particular keying feature that will fit into the particular groove 102, and the grooves 102 are arrayed in the X direction according to the placement of the keying features 92 in the X direction. Again, the grooves 102 each have a depth in the Z direction corresponding to the location of the particular keying feature 92 on the cartridge 42.

Accordingly, as is seen in FIGS. 8 and 9, the user of the printer 26 may insert a print cartridge 42 into the chute 58 while the keying and latching member 68 is slid to its rearward position. The print cartridge 42 drops into the chute 58 to a sufficient depth that the top of the cartridge is slightly below the member 68. In this location, the groove 100 aligns with latch feature 90, and the grooves 102 each align with a respective one of the key features 92. However, in this condition of the print cartridge 42, there is no bias force, or insufficient bias force, urging the electrical contacts of the cartridge 42 against the contacts 62 of the carriage 48. In order to provide such a bias force and assure good electrical contact of the print cartridge 42 with the printer 26, the user presses rearwardly on the upstanding ribs 104 of the cartridge 42 (i.e., with the thumb perhaps) while simultaneously pulling forwardly on the keying and latching member 68 by engaging an upstanding rib 106 on this member 68 (i.e., with the index finger perhaps). Thus, the member 68 slides forwardly in the guide ways 64 from the position of FIG. 9 to that of FIG. 10, until the latch spring 98 at portion 98*a* engages the latch 90 at rear wall 90*b*. The forward extent of movement of the member 68 is limited by a depending lip 108, best seen in FIG. 12, which engages against the back wall 58*d* of the carriage chute 58 so that the latch spring by its engagement with the latch wall 90*b* then provides a bias force urging the electrical contact pads 62 of the carriage 48 and of the print cartridge 42 into engagement with one another.

As will be apparent in view of the above, the print cartridge 42 has all keying features 92 in locations that allow the member 68 to fully slide forward (i.e., in the Z direction, recalling the illustrations and description of the embodiment of FIGS. 4*a* and 4*b*) over the print cartridge to its latched position seen in FIG. 10. It will be appreciated that in the event that an inappropriate print cartridge (i.e., similar to but not identically the same as print cartridge 42) is inserted into the chute 58, then this foreign print cartridge may have keying features that are in locations that do not allow the member 68 to move fully to its forward and latched position seen in FIG. 10. In that case, the foreign print cartridge is not acceptable for use in the printer 26. In order to prevent foreign print cartridges from being used in printer 26, which foreign print cartridges omit all keying features, it may be provided on member 68 that each (or selected ones) of the aligned grooves 102 has an associated sensor (i.e., a switch, for example) not illustrated in detail on FIG. 11, but indicated with arrowed numeral 126) each associated with a through hole 128 aligned with the location of particular ones of the keying features 92 relative to the member 68 when this member is fully forward in its latched position seen in FIG. 10. Each of these sensors 126 desirably has an interface (i.e., an electrical or optical interface, for example) with the printer 26 such that the sensor 126 must be activated by the particular key feature 92 in order for the printer 26 to operate. Thus, a second level of assurance is provided for the user of the printer 26 that only proper print cartridges 42 are used in the printer 26, and the performance and reliability of the printer 26 are preserved.

FIGS. 13–18 illustrate an alternative embodiment of the present invention. Because this alternative embodiment has many features in common with the first embodiment of FIGS. 6–12, features of the second embodiment that are the same as or which are analogous in structure or function to those features depicted and described above are referenced with the same numeral used above, but increased by two hundred (200). FIG. 13 depicts a portion of the mechanism of a printer 226, and of a print cartridge 242. Again, as is seen in the earlier Figures, the printer 226 includes a horizontally extending elongate guide rod 244, only a portion of which is illustrated. This guide rod 244 is spaced above and is parallel to a horizontally extending elongate guide rail 246. Only a portion of the guide rail 246 is depicted in FIG. 13. Carried upon the guide rod 244 and upon the guide rail 246 is a carriage base part 248, which is the part of the traverse mechanism of the printer 226. Upon the carriage base part 248 is carried an upwardly and downwardly opening chute 258 having a front wall, side walls, and a rear wall. A flexible circuit 260 is exposed within the chute 258 with an array of electrical contact pads 262.

In this embodiment, however, in order to provide for receiving and retaining a print cartridge 242 in the chute 258, two pairs of guide ways 264 are arranged one pair on each side of the chute 258, with the paired guide ways 264 extending laterally from side to side of the chute 258 (i.e., parallel to guide rod 244). These guide ways 264 have a respective C-shaped recess 266 in each one, with the recesses of each pair of guide ways facing toward one another. Slidably carried in the recesses 266 of the pair of guide ways 264 are a pair of opposed mirror-image keying and latching members 268, which will be further explained below.

Now further considering FIG. 13, it is seen that the print cartridge 242 includes a cartridge body 270, which is essentially the same as the body 70 of the cartridge 42 seen in the earlier Figures. That is, this second embodiment of printer may employ the same print cartridge used by the first embodiment. The keying features on the print cartridge utilized by this second embodiment may be the same as those of the first embodiment, or may be arranged differently within the alternatives explained above.

Considering now in FIGS. 16–18, the latch and key members 268 are shown in greater detail. It is seen that each of these members 268 are generally plate-like, are a substantial (although not necessarily an absolute) mirror image of one another (i.e., not absolute mirror image because of the differing keying features appearing in each member 268, which will be understood to be individual according to the keying features of the print cartridges explained earlier), and are each slidably carried in a respective one of the pair of opposed guide ways 264 for sliding movements in the "X" direction. The members 268 are each slidable between a first position (See, FIG. 14) in which the entire latch and key member 268 is to the left or to the right of the upwardly disposed opening of chute 258 (i.e., depending on which side of the chute the particular member 252 is located), and a second position (See, FIG. 15) in which the members 268 cooperatively extend partially across the chute 258 laterally across the cartridge 242.

FIG. 16 best reveals that the members 268 each define a notch or recess 296. At this notch 296, the latch feature 290 of the print cartridge 242 is received when the members 268 are each slid toward one another to the positions seen in FIG. 15 The engagement of the members 268 with the latch feature 290 is seen in FIG. 18. The latch feature 290 is captured between the members 268, and a recessed forward projection 258*d*' of the rear wall 258*d* of the chute 258. Thus, a bias of the cartridge 242 toward the contact pads 262 is provided when the latching members 268 are in their closed position seen in FIG. 15. Also considering FIGS. 16 and 17, it is seen that each of the members 268 also define (in this embodiment, although the invention is not so limited) 3 grooves 302, each aligning respectively with one of the keying features 292. That is, in this case, the 302 each have a lateral extent corresponding to the location along the X direction of the particular keying feature 292 on the cartridge 242 which is received into that groove when the latching members 268 are slid to their position seen in FIG. 15.

Accordingly, as is seen in FIG. 13, the user of the printer 226 may insert a print cartridge 242 into the chute 258 while the members 268 are slid apart laterally, after which the keying and latching members 268 are slid laterally toward one another across the chute 258. The print cartridge 242 drops into the chute 258 to a sufficient depth that the top of the cartridge is slightly below the members 268, but so that the keying features 292 project upwardly to an extent that they must be received into a particular groove 302. In this location of the print cartridge 242, when the members 268 are slid together across the chute 258, the recess 296 of each member 268 aligns with and receives about one-half of the latch feature 290, and the grooves 302 each align with a respective one of the key feature 292 on the respective left and right sides of the print cartridge 242.

In order to provide a bias force and assure good electrical contact of the print cartridge 242 with the printer 226, the user presses rearwardly on the upstanding ribs 304 of the cartridge 242 (i.e., with the thumb perhaps) while simultaneously pushing laterally on at least one of the keying and latching members 268 to move it to its position of FIG. 15. Once the first member 268 is in this position, the second of the pair of keying and latching members 268 may be moved to its position seen in FIG. 15 to complete the latching of the cartridge 242 within the carriage chute 258.

As will be apparent in view of the above, the print cartridge 242 has all keying features 292 in locations that allow the members 268 to fully slide laterally across the print cartridge to their latched position seen in FIG. 15. It will be appreciated that in the event that a inappropriate print cartridge (i.e., similar to but not the same as print cartridge 242) is inserted into the chute 258, then this foreign print cartridge may have keying features that are in locations that do not allow the members 268 to move fully to their lateral positions latching the cartridge in the chute 258, as is seen in FIG. 15. In that case, the foreign print cartridge is not acceptable for use in the printer 226. Again, in order to prevent foreign print cartridges from being used in printer 226, which foreign print cartridges omit all keying features, it may be provided on members 268, one or more of grooves 302 may have an associated sensor (i.e., a switch, for example) not illustrated in detail on FIGS. 13–18, but indicated with arrowed numerals 326 each associated with a through hole 328 aligned with the location of a particular feature 292

FIGS. 19–23 illustrate another alternative embodiment of the present invention. Again, because this alternative embodiment has many features in common with the earlier embodiments, features of the present embodiment which are the same as or which are analogous in structure or function to those features depicted and described above are referenced with the same numeral used above, but increased by four-hundred (400) over the first embodiment (i.e., by two-hundred (200) over the last previous embodiment).

FIG. 19 depicts a portion of the mechanism of a printer 426, and of a print cartridge 442. Again, as is seen in FIG. 19, the printer 426 includes a horizontally extending elongate guide rod 444, which is spaced above and is parallel to a horizontally extending elongate guide rail 446. Only a portion of the guide rod 444 and guide rail 446 are depicted in FIG. 19. Carried upon the guide rod 444 and upon the guide rail 446 is a carriage base part 448, which is the part of the traverse mechanism of the printer 426. Upon the carriage base part 448 is carried an upwardly and downwardly opening chute 458 having a front wall, side walls, and a rear wall. A flexible circuit 460 is exposed within the chute 458 with an array of electrical contact pads 462. Thus, the carriage base part 448 is reciprocal on the guide rod 444 and guide rail 446, and is motivated in this reciprocation by a toothed belt 456 drivingly connected to the carriage base part 448 and is reciprocated controllably by a motor drive mechanism (not seen in the drawing Figures).

In this embodiment, the carriage base part 448 carries an upwardly and downwardly opening chute 458 having a front wall 458*a*, a pair of side walls 458*b*, 458*c*, and a rear wall 458*d*. At the rear wall 258*d*, and above and behind this rear wall, the base part 448 carries a pivot pin 130. A keying and latching member 468 is pivotally carried upon this pivot pin 130. As is seen in FIG. 19, when this keying and latching member 468 is pivoted upwardly to a first position, the member pivots sufficiently above and somewhat behind the plane of rear wall 458*d* that a print cartridge 442 may be inserted downwardly into the chute 458 (arrowed on FIG. 19). Further considering FIG. 19, it is seen that the print cartridge 442 includes a cartridge body 470, which is essentially the same as the body 70 or 270 of the cartridge 42 or 242 seen in the earlier drawing Figures. That is, this third embodiment of printer may employ the same print cartridge used by the first and second embodiments. The keying features of this third embodiment may be the same as those of the first or second the first embodiments, or may be arranged differently within the alternatives illustrated and described above.

Considering now FIGS. 20–23, the latch and key member 468 is shown in greater detail. It is seen this member 468 is generally a toggle member, pivoted on pin 130, and having a plate-like portion 132 and a forwardly extending portion 134 (extending upwardly in the position of member 468 seen in FIG. 19). The plate-like portion 132 includes a recess 132*a* shaped and configured to receive the latch feature 490 of the print cartridge 442. Further, the plate-like portion 132 includes a plurality of recesses 136, each positioned to match with and receive a respective one of the key members 492 on the top wall of print cartridge 442.

However, in this case, it will be seen that the key and latch member 468 is not retained in a latched position by engagement with the latch feature 490. Rather, the print cartridge 442 is biased against the flexible circuit 460 and the contact pads 462 of this flexible circuit by engagement of the surface of member 468 at recess 132*a*. As is seen in FIGS. 19 and 20, the member 468 includes a forwardly extending portion 134 which curves forwardly and downwardly to the rear of the print cartridge 442. At the rear of print cartridge 442, the portion 134 terminates in a pair of spaced apart detent fingers 140. These detent fingers are spaced apart by a dimension that is slightly less than the width of the print cartridge 442 across the two side walls of this print cartridge. Accordingly, when the member 468 is pivoted downwardly over the print cartridge (comparing the positions of member 468 in FIGS. 19/20 and 21), the fingers 140 spring apart slightly to be received one on each side of the print cartridge. This engagement of the fingers 140 with the print cartridge retains the member 468 in its latched position seen in FIG. 20.

Further considering FIGS. 22 and 23, it is appreciated that the plate-like portion 132 is a "negative" of the keying features 492 defined and upwardly presented on the top wall of the print cartridge 442. That is, the plate-like portion 132 defines a downwardly opening recess matching each upwardly extending key block or pin 492 of the print cartridge 442. It is further appreciated that the plate-like portion 132 essentially approaches and engages with the keying features of the print cartridge 442 by relative movement along the "Y" axis (albeit along the negative "Y" axis) as the member 468 is pivoted through its movement and finally seats upon the top of print cartridge 442, recalling FIGS. 19 and 20. Although there is undoubtedly some pivotal aspect to this movement and engagement of the member 468 between its position of FIG. 20 and that of FIG. 21, so that the plate-like portion swings down from above to confront and engage the top of the print cartridge 442, with key features 490 entering recesses 136, the relative movement of the plate-like portion 116 during the finishing phase of this engagement, is essentially vertical and along the negative "Y" axis. As with the first two embodiments, the embodiment of the earlier drawing Figures, the embodiment of FIGS. 19–23 may be provided with one or more sensors to positively responding to the presence of keying features on the print cartridge 242 so as to enable operation of the printer in which the cartridge is received. Thus, a foreign print cartridge that is either devoid of keying features, or which has the wrong keying features, will not allow the printer to operate.

In view of the above, it is apparent that the present invention provides a keying apparatus and method inter-engaging a printer and print cartridge such that only appropriate print cartridges may be used in a particular printer. Thus, the performance and reliability of a printer may be preserved. Further, the keying arrangement according to the present invention may provide for the inter-engaging action between the printer and print cartridge to occur in any one or plural ones of an "X," "Y," or "Z" orthogonal directions. Each of the alternative embodiments may be provided also with sensors which respond positively to the presence of keying features on the print cartridge so as to enable operation of the printer. Further, a wide variety of engagement alternatives between a print cartridge and a printer is provided by the present invention. Thus, designers of ink jet printers and of ink jet print cartridges have a wide variety of design elements from which to choose in implementing this invention.

Although specific embodiments of the invention have been described and illustrated, the invention is not to be limited to the specific forms or arrangement of parts so described and illustrated. Thus, it is to be appreciated that the present invention is subject to several modifications and alterations that will suggest themselves to those ordinarily skilled in the pertinent arts. For example, a truly linear approach and engagement of a keying and latching feature along the Y axis (recalling the embodiment of FIGS. 19–23 Further, the reference to particularly preferred exemplary embodiments of the invention does not imply a limitation on the invention, and no such limitation is to be inferred. The invention is limited only by the spirit and scope of the appended claims.

I claim:

1. A print cartridge, comprising:

a cartridge body;

a printhead supported by said cartridge body;

an array of keying features defined on said cartridge body, each keying feature having one of a positive value and a null value; and a latch structure interposed within said array of keying features, wherein a positive value for a keying feature corresponds to that keying feature including an upstanding key block extending outwardly from said cartridge body, and a null value for a keying feature corresponds to that keying feature having substantially a space, wherein said keying features define a first keying pattern in a first direction, a second keying pattern in a second direction substantially perpendicular to said first direction, and a third keying pattern in a third direction substantially perpendicular to said first direction and said second direction, wherein at least one of said keying features of said third keying pattern has a positive value greater than binary "1" with said keying feature having a height commensurately greater than a unit height.

2. The print cartridge of claim 1, wherein said keying features are arrayed in a grid having a multitude of columns and a multitude of rows.

3. The print cartridge of claim 2, wherein said multitude of columns is six in number.

4. The print cartridge of claim 2, wherein said multitude of rows is three in number.

5. The print cartridge of claim 1, wherein said keying features are defined on a wall of said cartridge body.

6. The print cartridge of claim 5, wherein said latch structure includes a ramp surface extended from said wall of said cartridge body.

7. The print cartridge of claim 6, wherein said latch structure further includes a latch wall extended substantially vertically between a peak of said ramp surface and said wall of said cartridge body.

8. The print cartridge of claim 1, wherein said cartridge body defines a chamber for printing fluid and said printhead is adapted to eject droplets of the printing fluid.

9. A print cartridge, comprising:

a cartridge body;

a printhead supported by said cartridge body; and a plurality of keying locations arrayed on said cartridge body, each of said keying locations having one of a positive value represented by an outwardly extending keying feature and a null value represented by said keying location being free of such a keying feature, wherein said keying locations define a first keying pattern in a first direction, a second keying pattern in a second direction substantially perpendicular to said first directions, and a third keying pattern in a third direction substantially perpendicular to said first direction and said second direction, wherein at least one of said keying locations of said third keying pattern has a positive value greater than binary "1" with said keying location having a height commensurately greater than a unit height.

10. The print cartridge of claim 9, wherein said cartridge body includes a first wall and a second wall opposite said first wall, wherein said printhead is mounted on said second wall of said cartridge body and said keying locations are arrayed on said first wall of said cartridge body, and wherein said first direction and said second direction are in a plan substantially parallel with said first wall.

11. The print cartridge of claim 10, wherein said third direction is substantially perpendicular to said first wall of said cartridge body.

12. The print cartridge of claim 9, wherein each of said keying locations have one of a positive value of binary "1" or greater with said keying location including a keying feature extending outwardly a height commensurate with the positive value and a value of binary "zero" with said keying location being free of such a keying feature.

13. The print cartridge of claim 12, wherein each of said keying locations having a positive value have one of a positive value of binary "1" with said keying location having a unit height and a positive value greater than binary "1" with said keying location having a height commensurately greater than a unit height.

14. The print cartridge of claim 9, wherein said cartridge body defines a chamber for printing fluid and said printhead is adapted to eject droplets of the printing fluid.

15. A print cartridge body, comprising:

a wall;

a first array of keying features defined on said wall and a second array of keying features defined on said wall, each keying feature having one of a positive value and a null value; and a latch structure interposed within said first array of keying features and said second array of keying features, wherein a positive value for a keying feature corresponds to that keying feature including a key block extended from said wall, and a null value for a keying feature corresponds to that keying feature being free of such a key block, wherein said second array of keying features is spaced from said first array of keying features, and said first array of keying features and said second array of keying features each have a first value in a first direction and a second value in a second direction substantially perpendicular to said first direction, wherein at least one of said keying features has a positive value greater than binary, "1" with said keying feature having a height commensurately greater than a unit height.

16. The print cartridge of claim 15, wherein said first direction and said second direction are substantially parallel with said wall.

17. The print cartridge of claim 15, wherein said first direction is substantially parallel with said wall and said second direction is substantially perpendicular to said wall.

* * * * *

UNITED STATES PATENT AND TRADEMARK OFFICE

CERTIFICATE OF CORRECTION

PATENT NO. : 6,942,328 B2
APPLICATION NO. : 10/857128
DATED : September 13, 2005
INVENTOR(S) : Haldorsen It is certified that error appears in the above-identified patent and that said Letters Patent is hereby corrected as shown below:

Col. 15 (line 45), delete “directions,” and insert therefor --direction,--.

Signed and Sealed this

Fifth Day of September, 2006

JON W. DUDAS
*Director of the United States Patent and Trademark Office*